US010699862B2

(12) United States Patent
Galletti et al.

(10) Patent No.: US 10,699,862 B2
(45) Date of Patent: Jun. 30, 2020

(54) GAS-INSULATED HIGH-VOLTAGE SWITCHING DEVICE WITH IMPROVED MAIN NOZZLE

(71) Applicant: ABB Power Grids Switzerland AG, Baden (CH)

(72) Inventors: Bernardo Galletti, Nussbaumen (CH); Manuel Gotti, Turgi (CH); Markus Bujotzek, Zurich (CH); Martin Seeger, Oberentfelden (CH)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/253,367

(22) Filed: Jan. 22, 2019

(65) Prior Publication Data

US 2019/0172668 A1 Jun. 6, 2019

Related U.S. Application Data

(63) Continuation of application No. PCT/EP2017/068229, filed on Jul. 19, 2017.

(30) Foreign Application Priority Data

Jul. 21, 2016 (EP) ..... 16180549

(51) Int. Cl.
*H01H 33/70* (2006.01)
*H01H 33/91* (2006.01)

(52) U.S. Cl.
CPC ..... *H01H 33/7023* (2013.01); *H01H 33/91* (2013.01)

(58) Field of Classification Search
CPC ..... H01H 33/7023; H01H 33/703; H01H 33/7038; H01H 33/7069; H01H 33/7076; H01H 2033/902

(Continued)

(56) References Cited

U.S. PATENT DOCUMENTS 5,739,495 A * 4/1998 Marin ..... H01H 33/7061 218/62
6,040,970 A * 3/2000 Lehmann ..... H01H 33/7061 218/53

(Continued)

FOREIGN PATENT DOCUMENTS

DE 102011007103 A1 10/2012
EP 1826792 A1 8/2007
WO 2009124582 A1 10/2009

OTHER PUBLICATIONS

European Patent Office, International Search Report & Written Opinion issued in corresponding Application No. PCT/EP2017/068229, dated Oct. 24, 2017, 13 pp.

(Continued)

*Primary Examiner* — William A Bolton
(74) *Attorney, Agent, or Firm* — Sage Patent Group

(57) ABSTRACT

A gas-insulated high-voltage switching device which includes an arcing contact arrangement having a first arcing zone member and a second arcing zone member that are movable relative to one another along an axis. An auxiliary nozzle surrounds at least a part of a second arcing contact unit and has an auxiliary nozzle throat having an axial extension and allowing passage at least of an end of the first arcing contact unit. A main nozzle throat has an axial extension sideways of the auxiliary nozzle throat and allows passage at least of the end of the first arcing contact unit. A cross-sectional area of the main nozzle throat is substantially decreasing in the direction away from the auxiliary nozzle throat so as to form a substantially converging duct for the flow of an arc-extinguishing gas.

24 Claims, 3 Drawing Sheets

(58) Field of Classification Search
USPC ..... 218/49, 37, 46, 51, 53, 54, 62, 63, 64
See application file for complete search history.

(56) References Cited

U.S. PATENT DOCUMENTS

| | | | | |
|---|---|---|---|---|
| 6,483,064 | B2 * | 11/2002 | Dufournet | H01H 33/703 218/43 |
| 6,744,000 | B1 * | 6/2004 | Bergmann | H01H 33/24 218/43 |
| 8,633,413 | B2 * | 1/2014 | Cernat | H01H 33/703 218/59 |
| 2008/0314873 | A1 | 12/2008 | Dahlquist et al. | |
| 2011/0297648 | A1 * | 12/2011 | Dienemann | H01H 33/703 218/54 |

OTHER PUBLICATIONS

European Patent Office, Extended Search Report issued in corresponding Application No. 16180549.4, dated Dec. 1, 2016, 6 pp.

* cited by examiner

GAS-INSULATED HIGH-VOLTAGE SWITCHING DEVICE WITH IMPROVED MAIN NOZZLE

TECHNICAL FIELD

The present disclosure relates the field of high voltage (HV) switching technology and concerns a gas-insulated high-voltage switching device, such as a gas-insulated high-voltage circuit breaker. Specifically, embodiments relate to the shape of a nozzle throat of a main nozzle in an arcing contact assembly of the gas-insulated high-voltage switching device, and to methods of manufacturing and operating such a gas-insulated high-voltage switching devices.

BACKGROUND

Switching devices arc well known in the field of medium and high voltage switching applications. They are predominantly used for interrupting a current, when an electrical fault occurs. As an example, circuit breakers have the task of opening contacts and keeping them far apart from one another in order to avoid a current flow even in case of high electrical potential originating from the electrical fault itself. The electrical switching devices, like said circuit breaker, may need to carry high nominal currents of 3 kA to 6.3 kA. They may switch very high short circuit currents of 31.5 kA to 80 kA at very high voltages of 72 kV to 1200 kV (high current duty, such as SLF90 duty). Circuit breakers may also need to perform low short-circuit current duty, such as T10, T30 and out-of-phase duty, up to about three times the nominal currents, e.g. from 9 kA to 15 kA. The operation principle of circuit breakers is known and will not be described here in detail.

Such electrical switching devices like circuit breakers comprise an arcing contact arrangement used for taking over the current from the nominal contact(s) during the opening and closing operation of the device. Amongst others, one type of circuit breakers uses a tulip-shaped arcing contact, comprising contact fingers arranged concentrically around a longitudinal axis of the circuit breaker. This arcing configuration is called a contact tulip. The mating arcing contact is a pin or rod or a tube, which is inserted into the contact tulip during a closing operation of the switching device. An auxiliary nozzle encloses at least partially the contact tulip. A main nozzle at least partially encloses the auxiliary nozzle.

Circuit breakers are designed in a way that the insulating and cooling gas is accelerated effectively in the nozzle system. In high current duty, the flow between the main nozzle and auxiliary nozzle should reach sonic conditions on either side of the stagnation point at a comparatively short distance from it and then accelerate to supersonic speed. This flow pattern corresponds to an effective convective cooling of an arc and favors the interruption of the conductive path.

However, in low short-circuit current duties, such as T10, T30 or out-of-phase duty, the circuit breaker may exhibit a low dielectric withstand, as such flow conditions may not be reached. Therefore, there is a need to improve the dielectric withstand of gas-insulated high-voltage switching devices, such as gas-insulated high-voltage current breakers, particularly with respect to low short-circuit current duties.

DE 10 2011 007 103 A1 discloses a circuit breaker having a heating channel for guiding arc-heated gases to a heating volume and back again to the arcing zone. The heating channel smoothly merges into the nozzle throat. The nozzle opens divergently, when starting from the heating channel entrance and moving axially away from the arcing zone. Moreover, In this design the main nozzle throat has zero length in axial direction.

SUMMARY

According to an embodiment, a gas-insulated high-voltage switching device is provided. The gas-insulated high-voltage switching device includes an arcing contact arrangement. The arcing contact arrangement includes a first arcing zone member and a second arcing zone member. The first and second arcing zone members are movable relative to one another along an axis. The first arcing zone member includes a first arcing contact unit. The second arcing zone member includes a second arcing contact unit configured to receive the first arcing contact unit, and an auxiliary nozzle surrounding at least a part of the second arcing contact unit. The auxiliary nozzle has an auxiliary nozzle throat. The auxiliary nozzle throat has an axial extension and allows passage at least of an end of the first arcing contact unit. The second arcing zone member further includes a main nozzle surrounding at least a part of the auxiliary nozzle. The main nozzle has a main nozzle throat. The main nozzle throat has an axial extension sideways (here to the right-hand side along axis B) of the auxiliary nozzle throat and allows passage at least of the end of the first arcing contact unit. A cross-sectional area of the main nozzle throat is substantially decreasing in the direction away from the auxiliary nozzle throat, so as to form a substantially converging duct, in particular converging or strictly converging duct, for the flow of an arc-extinguishing gas.

Another embodiment relates to a method of manufacturing the gas-insulated high-voltage switching device as described herein. The method includes controlled shaping of the main nozzle throat to form the substantially converging duct for the flow of the arc-extinguishing gas.

A further embodiment relates to a method of operating the gas-insulated high-voltage switching device described herein. The method includes providing the gas-insulated high-voltage switching device, and performing a low short-circuit current switching operation wherein the switching current is smaller than 0.3 times the rated short-circuit current.

Further advantages, features, aspects and details that can be combined with embodiments described herein become evident from the dependent claims, claim combinations, the description and the drawings.

BRIEF DESCRIPTION OF THE FIGURES

More details will be described in the following with reference to the figures, wherein.

DETAILED DESCRIPTION

Figure 1:
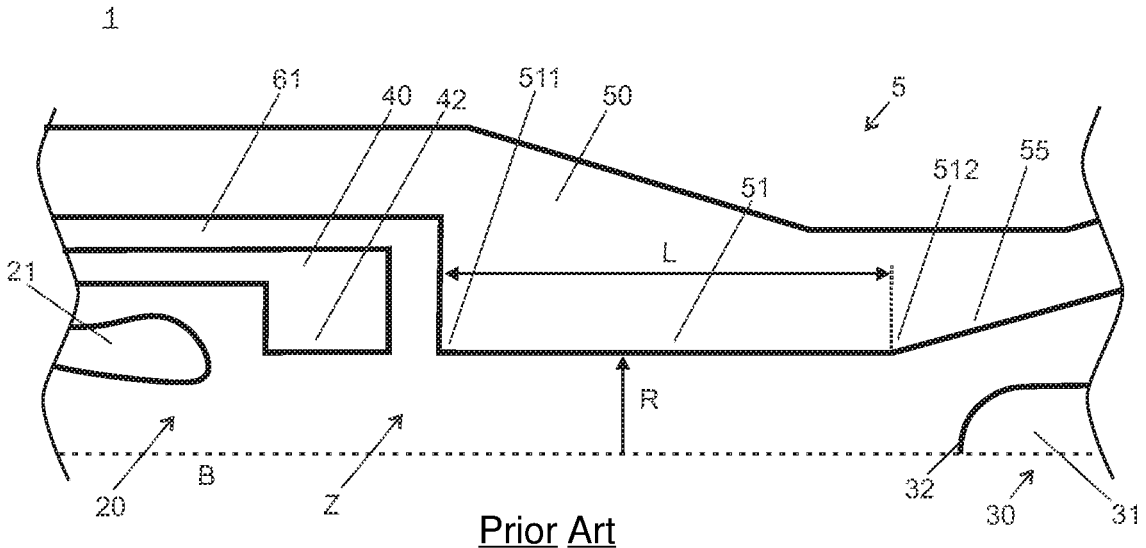
Prior Art FIG. 1
FIG. 1 shows a schematic side-view on a section along an axis B of a known gas-insulated high-voltage switching device.

In the following, embodiments of the invention are described. Embodiments and parts thereof can be combined in any manner. For example, any aspect of an embodiment described herein can be combined with any other aspect of any other embodiment to form yet further embodiments. The detailed description of embodiments is provided for illustration.

For simplicity, embodiments described herein often refer to a circuit breaker, specifically to a gas-insulated high-voltage self-blast circuit breaker, instead of referring to a gas-insulated high-voltage switching device. It is to be understood that this is not meant as a limitation, and the switching device may be an earthing device, a fast-acting earthing device, a circuit breaker, a generator circuit breaker, a disconnector, a combined disconnector and earthing switch, or a load break switch in power transmission and distribution systems.

The term high voltage relates to voltages that exceed 1 kV, and typically relates to nominal voltages in the range from 72 kV to 550 KV, for example about 145 kV, about 245 kV or about 420 kV. Nominal currents of the switching device are typically in the range from 3 kA to 5 kA, for example about 3.15 kA or about 4 kA. The current, which flows during the abnormal conditions in which the switching device performs its duty, may be interchangeably referred to as the switching current, the breaking current or the short circuit current. The switching current may be in the range from 31.5 kA to 80 kA, which is termed high short-circuit current duty. In low short-circuit current duties, the switching current is typically larger than the nominal current and smaller than 0.3 times the rated short-circuit current, e.g. is at most 24 kA. During a switching/breaking operation, switching/breaking voltages may be very high, e.g. in the range from 110 kV to 1200 kV.

The gas-insulated high-voltage switching devices have an arcing contact arrangement with parts that are movable relative to one another along an axis. This axis may be a symmetry axis of the arcing contact arrangement, in particular an axis of n-fold or continuous rotational symmetry. The short term "rotational symmetry" shall mean a continuous rotational symmetry. An n-fold rotational symmetry means a discrete symmetry regarding rotations by angles which are multiples of 360°/n, where n is an integer number larger than one. The term "axial" designates an extension, distance etc. in the direction of the axis. An axial separation between parts means that these parts are separated from each other when seen or measured in the direction of the axis. The term "sideways" is to be understood with respect to the axial direction. The term "radial" designates an extension, distance etc. in a direction perpendicular to the axis. The term "cross-section" means a plane perpendicular to the axis, and the term "cross-sectional area" means an area in such a plane.

In the following, same reference numerals denote structurally or functionally same or similar elements. The description of such elements will typically not be repeated.

FIG. 1 shows a schematic side-view of a section along an axis B of a gas-insulated high-voltage self-blast circuit breaker 1 known from the prior art. The circuit breaker 1 shown in FIG. 1 is rotationally symmetric about the axis B, and the lower half of the section along the axis B is not shown, as it corresponds to the upper half mirrored at the axis B. The circuit breaker 1 includes an arcing contact arrangement 5 with a first arcing zone member 30 and a second arcing zone member 20. The first arcing zone member 30 includes a contact tulip 21, an auxiliary nozzle 40 and a main nozzle 50 in a coaxial arrangement with respect to the axis B. The second arcing zone member 20 includes a contact pin 31. A nominal contact arrangement, which typically surrounds the arcing contact arrangement, and a housing of the circuit breaker 1 are not shown.

The auxiliary nozzle 40 at least partially surrounds the contact tulip 21. The auxiliary nozzle 40 includes an auxiliary nozzle throat 42 which has an axial extension to form a flow duct for the flow of an arc-extinguishing gas. The main nozzle 50 surrounds the auxiliary nozzle 40 at least partially. The main nozzle 50 includes a main nozzle throat 51, which has an axial extension to form a flow duct for a flow of the arc-extinguishing gas. The main nozzle throat 50 is arranged sideways, i.e. here right-hand in direction along axis B, of the auxiliary nozzle throat 42. A heating channel 61 is formed between the auxiliary nozzle 40 and the main nozzle 50, and provides an axial separation between the auxiliary nozzle throat 42 and the main nozzle throat 51. The heating channel 61 is in fluid communication with the auxiliary nozzle throat 42 and the main nozzle throat 51 at a first end, and is in fluid communication with a pressure volume (not shown) at a second end. The pressure volume may be a heating volume or puffer volume or a combination of heating volume and puffer volume. The main nozzle throat 51 has a first end 511 towards the auxiliary nozzle throat 42, adjacent to the first end of the heating channel 61, and has a second end 512 away from the auxiliary nozzle throat 42. At the second end of the main nozzle throat 51, the main nozzle 50 widens into a diffuser portion 55. Nozzle throats may be the narrowest parts of nozzles, i.e. parts of the nozzles enclosing the smallest void volume per unit length along the axis B.

The first arcing zone member 30 and the second arcing zone member 20 arc movable relative to one another along the axis B. Relative movement means that the first arcing zone member 30, the second arcing zone member 20 or both the first and second arcing zone members 20, 30 may move along the axis B so that a displacement between the first arcing zone member 30 and the second arcing zone member 20 occurs. Specifically, the relative motion can bring the contact pin 31 and the contact tulip 21 into physical contact with each other and can pull them apart to break the physical contact, and eventually also the electrical contact. A circuit breaker in which both the first arcing zone member 30 and the second arcing zone member 20 are movable is called a double-motion circuit breaker, and else it is called a single-motion contact breaker. The circuit breaker may include drives (not shown) to effect movement of the first arcing zone member 30, the second arcing zone member 20, or both. The contact pin 31 is shown in a retracted position in FIG. 1, in which it does not physically contact the contact tulip 21. The contact pin 31, or at least the end 32 of the contact pin 31 nearest to the contact tulip 21, can pass through the main nozzle throat 51 and through the auxiliary nozzle throat 42, which are shaped accordingly to allow such passage.

The main nozzle throat 51 has a constant cross-sectional area $A1=\pi R^2$ along its entire length L, wherein R is a constant radius (measured from the axis B) as shown in FIG. 1. The main nozzle throat 51 provides a constant flow cross-section for the flow of the arc-extinguishing gas, while the flow cross-section of the diffuser portion 55 increases when seen in downstream axial direction (here direction to the right along axis B). From the prior art, main nozzle throats 51 arc known, which also increase in cross-sectional area in the direction of the flow of the arc-extinguishing gas, i.e., in the direction along the axis B away from the auxiliary nozzle throat 42 (i.e. in axial downstream direction), and their diffusor portions may have a cross-section which increases even more than shown in FIG. 1.

In the process of circuit breaking, an arc forms when the physical contact between the contact pin 31 and the contact tulip 21 is broken, the arc-extinguishing gas flows from the pressure volume through the heating channel 61 and then through the flow duct formed by the auxiliary nozzle throat 42 and through the flow duct formed by the main nozzle throat 51, i.e. in opposite directions, to eventually extinguish the arc. The region, in which the arc forms between the contact tulip 21 and the contact pin 31, is called the arcing zone Z.

It was found that such a circuit breaker 1 may exhibit a low dielectric withstand in particular in low short-circuit current duties.

Figure 2:
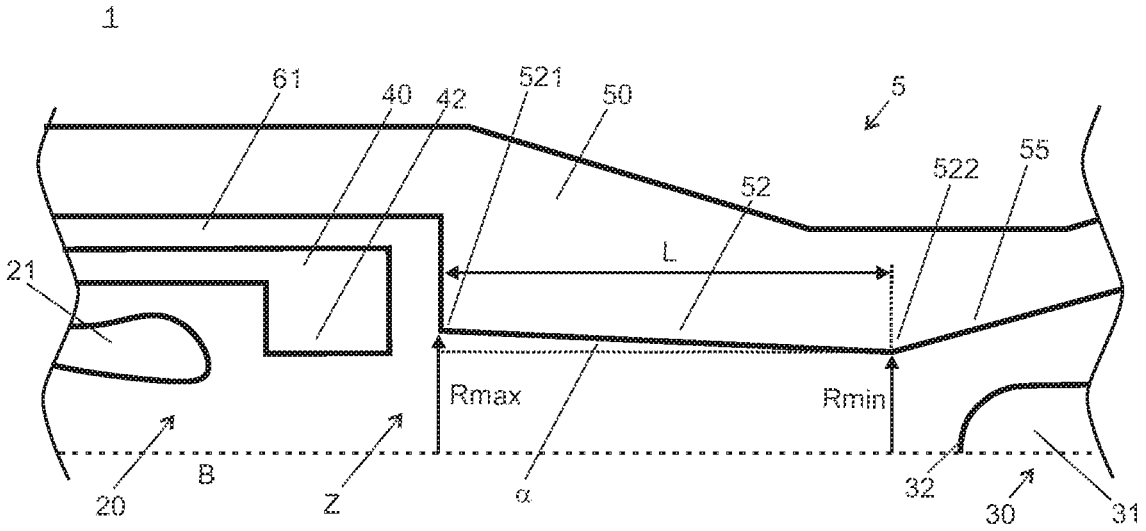
FIG. 2 shows a schematic side-view on a section along an axis B of a gas-insulated high-voltage switching device according to an embodiment.

FIG. 2 shows a schematic side view on a section along the axis B of a gas-insulated high-voltage self-blast circuit breaker 1 according to an embodiment of the present invention. In contrast to the prior art circuit breaker shown in FIG. 1, the circuit breaker according to this embodiment has a main nozzle 50 with a main nozzle throat 52, the cross-sectional area of which decreases in the direction away from the auxiliary nozzle throat 42, i.e., in the direction of the flow of the arc-extinguishing gas or sideways of the auxiliary nozzle throat 42. That means, the larger cross-sectional area of the main nozzle throat 52 is at a first end 521 of the main nozzle throat 52 adjacent to the heating channel 61 and the narrower cross-sectional area of the main nozzle throat 52 is at a second end 522 of the main nozzle throat 52 remote from the heating channel 61 or adjacent to the main nozzle diffuser portion 55. The main nozzle throat 52 thus forms a converging flow duct for the flow of the arc-extinguishing gas, i.e. in downstream direction or here towards the right-hand side.

In the embodiment shown in FIG. 2, the shape of the main nozzle throat 52 can be frusto-conical. In the side view on the section along the axis B of FIG. 2, this can be seen from the depicted section of a radially inner surface of the main nozzle throat 52 running in a straight line from a maximal radius Rmax at the first end of the main nozzle throat 52 to a minimal radius Rmin at the second end of the main nozzle throat 52. In particular, an aperture angle $\alpha$ of the insulating nozzle throat 52 is shown in FIG. 2; the aperture angle $\alpha$ is defined as $\alpha=\arctan((R_{max}-R_{min})/L)$, wherein L is the length of the main nozzle throat. The aperture angle $\alpha$ is larger than zero, and may be e.g. at most 15°.

FIG. 2 shows an example of a shape of the main nozzle throat 52, which can increase the dielectric withstand of the circuit breaker, in particular in low short-circuit current duties. Without wishing to be bound by any particular theory, it is believed that the reason why this is so is the following.

Drives that operate such a circuit breaker may not be powerful enough to create sufficient pressure build up to flush the hot gas out of the arcing zone after current zero. This is especially true for a self-blast double-motion circuit breaker, which, as opposed to a single motion circuit breaker, yields lower mechanical compression due to the lower speed of the puffer side, i.e. the side of the first arcing zone member 30.

In particular in a low short-circuit current duty (T10, out-of-phase, T30), the pressure that is built up in the volume by the arc is small and of the same order of magnitude as that generated mechanically by the drive. The resulting stagnation pressure at current zero in these cases may not be sufficient to achieve supersonic flow conditions inside the main nozzle 51 of the prior art circuit breaker. As a consequence, the hot gas between the arcing contacts may be evacuated at a comparatively low speed and may concentrate in front of the end 32 of the contact pin 31. This flow picture gets worse in case of 60 Hz currents, as there is a shorter time available for the gas to sweep the arcing zone after flow reversal.

In case of successful thermal interruption, the transient recovery voltage that is applied between the breaker contacts can then cause the dielectric breakdown of the gas. The onset of the latter was analyzed to take place in a point of the gas, where the ratio between the electric field magnitude and the gas density is the largest. Such a weak point is typically located in the region of hot gas standing in front of the contact pin 31 mentioned above, where low values of the gas density were found to be combined with high values of the electric field. The leader of the discharge may then travel along a path of minimum energy trying to reach the metal parts on the puffer side, an event that would lead to the dielectric failure of the prior art circuit breaker.

It was found that the flow regime inside the nozzles of a self-blast circuit breaker, especially of a double-motion self-blast circuit breaker, can be subsonic, particularly in a low short-circuit current duty operation due, to the small mechanical pressure buildup. The hot gas may thus not be removed efficiently from the arcing zone. In the cases of high current duties, the situation may be different, and the gas may be ejected supersonically from the arcing zone of prior art circuit breakers due to a high pressure gradient generated by ablation in the arcing phase. If a region of hot gas with low density is established towards the second end of the main nozzle throat in front of the contact pin, this region is where the dielectric breakdown is more likely to occur when the transient recovery voltage is applied to the circuit breaker.

Circuit breakers or switching devices according to embodiments described herein, such as the circuit breaker 1 shown in FIG. 2, provide a form of the nozzle throat 52 of the main nozzle 50 which increases the gas density inside the arcing zone towards the second end of the main nozzle throat 52, in particular in low short-circuit current duty operations. Thereby, the risk of dielectric breakdown is reduced, i.e. the dielectric withstand against such breakdown is increased.

Generally, the cross-sectional area of the main nozzle throat 52 is formed to substantially decrease in the direction away from the auxiliary nozzle throat 42. The flow duct formed by the main nozzle throat 52 is therefore manufactured to be substantially converging in the direction of the gas flow of the arc-extinguishing gas. Since subsonic gas flows accelerate in converging ducts, a convergent profile for the insulating nozzle throat 52 helps to have a higher flow velocity at the second end of it. The higher flow velocity supports a more effective removal of the hot gas that resides in the region adjacent to the end of the contact pin 31 after that the arc has been extinguished thermally.

The physical picture described above has been verified by means of computational fluid dynamics (CFD) simulations. Most importantly, the improvements of dielectric recovery achieved by the converging main nozzle throat 52 have been confirmed by the results of full power tests performed under the same conditions as for a prior art circuit breaker and in a circuit breaker implementing the converging main nozzle 52 (i.e. main nozzle 52 converging in downstream direction).

In completely general embodiments, the (substantially) converging flow duct of the main nozzle 52 is converging in downstream direction of the arc-extinguishing gas.

In other completely general embodiments, the (substantially) converging flow duct of the main nozzle 52 has an axial extension between a stagnation point of the arc-extinguishing gas in downstream direction towards a second end 522 of the main nozzle throat 52 (i.e. which is remote from the heating channel, and in particular adjacent to a main nozzle diffuser portion 55).

Or in yet other completely general embodiments, the (substantially) converging flow duct of the main nozzle 52 has an axial extension between a a first end 521 of the main nozzle throat 52 adjacent to the heating channel 61 and a second end 522 of the main nozzle throat 52 remote from the heating channel 61, and in particular adjacent to a main nozzle diffuser portion 55. In particular, the axial position of a stagnation point of the arc-extinguishing gas is located axially outside or upstream of the (substantially) converging flow duct of the main nozzle 52.

According to embodiments described herein, a gas-insulated high-voltage switching device is provided. The switching device may be a circuit breaker or may be another device mentioned hereinbefore. The gas-insulated high-voltage circuit breaker may be a gas-insulated high-voltage self-blast circuit breaker, which may feature single motion or double motion. The circuit breaker may in particular be a gas-insulated high-voltage double-motion self-blast circuit breaker. For the latter, the effect of increasing the dielectric withstand should be most pronounced, since the gas flow of the arc-extinguishing gas in the arcing zone is more likely to be subsonic in the low short-circuit current duties due to the slower absolute speeds of movement of its parts, which leads to smaller mechanical pressure build up. For simplicity, exemplary reference will be made to a circuit breaker hereinafter.

The circuit breaker may be operable at a grid current frequency, which may be e.g. 50 Hz as in Europe or 60 Hz as in other countries. The higher the frequency of the grid current, the more pronounced the improvement should be by the present design, because higher grid current frequency leaves less time to purge hot gases out of the arcing zone, which may lead to dielectric failure.

The circuit breaker 1 includes an arcing contact arrangement 5. The arcing contact arrangement 5 includes a first arcing zone member 30 and a second arcing zone member 20. The first and second arcing zone members 30, 20 are movable relative to one another along an axis B. The circuit breaker 1 may include a housing in which the first and second arcing zone members 30, 20 are arranged. The first arcing zone member 30 may be movable relative to the housing along the axis B by a first drive or may be mounted stationary with respect to the housing. The second arcing zone member 20 may be movable relative to the housing along the axis by a second drive. The housing may include an insulator portion supporting a first metallic current terminal electrically connected to the first arcing zone member 30 and a second metallic current terminal electrically connected to the second arcing zone member 20.

The circuit breaker may include a nominal contact arrangement including a first nominal contact unit and a second nominal contact unit. The arcing contact arrangement 5 and the nominal contact arrangement may form a contact arrangement of the circuit breaker 1. The first nominal contact unit may be electrically connected to the first metallic current terminal and the second nominal contact unit may be electrically connected to the second metallic current terminal. The first and second nominal contact units may be movable relative to each other along the axis B. The first nominal contact unit may be in a fixed spatial relationship to the first arcing zone member 30, and may move or be stationary with respect to the housing together with the first arcing zone member 30. The second nominal contact unit may be in a fixed spatial relationship to the second arcing zone member 20, and may move with respect to the housing together with the second arcing zone member 20. Electrical connections to the metallic current terminals may be sliding contacts, if the parts that electrically contact the metallic current terminals are movable relative to the metallic current terminals.

The first arcing zone member 30 includes a first arcing contact unit 31. The first arcing contact unit 31 may be an arcing contact pin 31. The second arcing zone member 20 includes a second arcing contact unit 21 configured to receive the first arcing contact unit 31, in particular to receive a free end thereof. The second arcing contact unit 21 may be an arcing contact tulip 21 configured to receive the arcing contact pin 31, in particular a free end or tip thereof.

The second arcing zone member 20 includes an auxiliary nozzle 40 surrounding at least a part of the second arcing contact unit 21. The auxiliary nozzle 40 has an auxiliary nozzle throat 42. The auxiliary nozzle throat 42 has an axial extension and allows passage at least of an end of the first arcing contact unit 31, such as the free end or tip of an arcing contact pin 31. The auxiliary nozzle 40 may include or be covered with or be made of a halogenated polymer, e.g. on the basis of polytetrafluorethylene (PTFE). The auxiliary nozzle throat 42 or the auxiliary nozzle 40 may have an n-fold discrete rotational symmetry or a continuous rotational symmetry with respect to the axis B, where n is an integer larger or equal to three, e.g. equal to 4, 6, 8 or more.

The second arcing zone member 20 further includes a main nozzle 50 surrounding the auxiliary nozzle 40 or at least a part thereof. The main nozzle 50 has a main nozzle throat 52. The main nozzle throat 52 has an axial extension sideways of the auxiliary nozzle throat 42 and allows passage at least of the end of the arcing contact pin 31. In other words, the main nozzle throat 52 has an axial extension of length L, and the main nozzle throat 52 is arranged at the side of the auxiliary nozzle throat 42, wherein "sideways of" or "at the side of" are to be understood with respect to the axis B, i.e. in the direction of the axis B and away from the auxiliary nozzle 40 or on the other side of the arcing zone Z (relative to the auxiliary nozzle 40). The auxiliary nozzle 40 may include or be covered with or be made of a halogenated polymer, e.g. on the basis of polytetrafluorethylene (PTFE). The main nozzle throat 52 or the main nozzle 50 may have an n-fold discrete rotational symmetry or a continuous rotational symmetry with respect to the axis B, where n is an integer larger or equal to three, e.g. equal to 4, 6, 8 or more. A part with continuous rotational symmetry also possesses n-fold discrete rotational symmetry for any n.

The circuit breaker 1, in particular the contact arrangement 5, may include a carrier to which the second arcing contact unit 21, the second nominal contact unit, the auxiliary nozzle 40, the main nozzle 50, or any combination thereof may be attached to the carrier. The carrier may be movable relative to the housing, keeping the parts attached to it in a fixed spatial relationship with respect to each other.

The circuit breaker 1 may include a pressure volume or pressure chamber. The pressure volume or pressure chamber may be a heating volume and/or puffer volume. The pressure volume or pressure chamber may be bounded, inter alia, by the second arcing contact unit 21, the second nominal contact unit and/or the carrier. The second arcing zone arrangement 20 may include a heating channel 61 formed between the auxiliary nozzle 40 and the main nozzle 50. The heating channel 61 may have a first end opening into a space between the auxiliary nozzle throat 42 and the main nozzle throat 52, the space being part of the arcing zone Z, and may have a second end opening into the pressure chamber. The heating channel 61 may thus be in fluid communication with the pressure chamber on the second end, and on the first end with a part of the arcing zone lying between the two nozzle throats 42, 52 of the auxiliary and main nozzle 40, 50, respectively. The second arcing zone arrangement 20 may further include an auxiliary channel formed between the second arcing contact unit 21 and the auxiliary nozzle 40. The auxiliary channel may have a first end opening into a space between a free end of the second arcing contact unit 21 and the auxiliary nozzle throat 42, and may have a second end opening into an exhaust volume.

Any two or more parts of the arcing contact arrangement 5, nominal contact arrangement and/or contact arrangement may coaxially be arranged with respect to the axis B. In particular, the first arcing contact unit 31, the second arcing contact unit 21, the auxiliary nozzle 40 and the main nozzle 50 may be in coaxial arrangement with respect to the axis B. The first nominal contact unit and the second nominal contact unit and the carrier may be in coaxial arrangement with respect to the axis B, as well. The pressure chamber, the heating channel 61, the auxiliary channel and/or the carrier may also be in a coaxial arrangement with respect to the axis B. Any part of, or the entirety of, the arcing contact arrangement, nominal contact arrangement, contact arrangement, pressure chamber, heating channel, auxiliary channel and/or carrier may have an n-fold discrete rotational symmetry or a continuous rotational symmetry with respect to the axis, where n is an integer larger or equal to three, e.g. equal to 4, 6, 8 or more.

According to embodiments, a cross-sectional area of the main nozzle throat is substantially decreasing in the axial direction away from the auxiliary nozzle throat. The main nozzle throat forms a substantially converging flow duct for the flow of an arc-extinguishing gas. The main nozzle throat has a substantially decreasing cross-section in the axial direction away from the auxiliary nozzle throat and forms a substantially converging flow duct for the flow of the arc-extinguishing gas, such that the arc-extinguishing gas experiences an overall acceleration in the main nozzle throat, in particular for the subsonic flow regime typical of low short-circuit current duty conditions. In more generality, a substantially converging flow duct can be defined as a duct of varying shape, which provides a net increase, in particular a monotonous increase, in acceleration of the gas flow. In this way, the flow velocity at the end of the main nozzle throat in the vicinity of the retracted first arcing contact unit is increased, thereby supporting a more effective removal of hot gas from the vicinity of the retracted first arcing contact unit after the arc has been extinguished thermally. The main nozzle throat may preferably form a strictly converging flow duct, and its cross-section may thus strictly monotonously decrease in the axial direction away from the auxiliary nozzle throat, but may alternatively exhibit some deviations or undulations of bounded extent to the strictly converging shape, as long as the necessary overall acceleration of the arc-extinguishing gas is achieved.

The main nozzle 50 may include a diffusor portion 55. The diffuser portion 55 may be adjacent, in the axial direction away from the auxiliary nozzle throat 42, to the main nozzle throat 52. The cross-sectional area of the diffuser portion 55 may increase in the axial direction away from the auxiliary nozzle throat 42. The diffuser portion 55 may form a diverging duct for the flow of the arc-extinguishing gas (i.e. in downstream direction). The main nozzle throat 52 may be arranged, in axial direction, between the diffuser portion 55 and a portion of the main nozzle 50 that defines one wall of the heating channel 61 (the other wall of the heating channel 61 being defined by the auxiliary nozzle 40).

The main nozzle throat 52, i.e. the (substantially) converging flow duct of the main nozzle throat 52, may have a first end in the axial direction towards the auxiliary nozzle throat 42, and a second end in the axial direction away from the auxiliary nozzle throat 42. The second end may be adjacent to the diffuser portion 55 of the main nozzle 50. The main nozzle throat 52 may have a length L in the axial direction. The length L may be in the range of 15 mm to 80 mm. The main nozzle throat 52 may have a largest cross-sectional area Amax at the first end 521 of the main nozzle throat 52. The main nozzle throat 52 may have smallest cross-sectional area Amin at the second end 522 of the main nozzle throat 52. When the main nozzle throat has an n-fold discrete rotational symmetry, in particular if any cross-sectional area of the main nozzle throat is a regular convex polygon with circumradius R, the largest cross-sectional area Amax is related to the largest circumradius Rmax by $Amax=\frac{1}{2}\, n\, Rmax^2 \sin(2\pi/n)$, and likewise the smallest cross-sectional area Amin is related to the smallest circumradius Rmin by $Amin=\frac{1}{2}\, n\, Rmin^2 \sin(2\pi/n)$. When the main nozzle throat 52 has a continuous rotational symmetry, so any cross-sectional area of the main nozzle throat 52 is a circle, the largest cross-sectional area Amax is related to the largest radius Rmax by $Amax=\pi\, Rmax^2$, and the smallest cross-sectional area Amin is related to the smallest radius by $Amin=\pi\, Rmin^2$. $Amax>Amin$ and $Rmax>Rmin$ holds. Radii arc measured from the axis B in radial direction, i.e. perpendicular to the axis B. A main nozzle throat with continuous rotational symmetry is preferred, inter alia since it offers advantages such as ease of manufacture and favorable flow conditions. The main nozzle throat may have an aperture angle $\alpha$ which is defined as $\alpha=\arctan((Rmax-Rmin)/L)$, where L is the length of the main nozzle throat, in particular of the substantially converging flow duct. The aperture angle $\alpha$ is larger than zero. The aperture angle $\alpha$ may be at most 15°. The aperture angle $\alpha$ may e.g. be in the range of 0.5° to 10°. The length of Rmax, Rmin or of a mean radius of the main nozzle throat may lie in the range from 5 mm to 20 mm.

The cross-sectional area of the main nozzle throat may be strictly monotonously decreasing in the axial direction away from the auxiliary nozzle throat or towards the diffuser portion of the main nozzle or in the direction of the flow of the arc-extinguishing gas through the main nozzle throat. The main nozzle throat may form a strictly converging flow duct for the flow of the arc-extinguishing gas. The cross-sectional area may decrease quadratically along the length of the main nozzle throat. In the typical case in which the main nozzle throat has an n-fold discrete rotational symmetry or a continuous rotational symmetry, the circumradius or radius of the cross-sectional areas along the length of the main nozzle throat may decrease linearly in the axial direction away from the auxiliary nozzle throat or towards the diffuser portion of the main nozzle or in the direction of the flow of the arc-extinguishing gas through the main nozzle throat. The shape of the main nozzle throat 52 may be frusto-conical, such as e.g. shown in FIG. 2.

The cross-sectional area of the main nozzle throat may be substantially decreasing or strictly monotonously decreasing in a second half of the length of the main nozzle throat, the second half of the length of the main nozzle throat lying in the axial direction away from the auxiliary nozzle throat or towards the diffuser portion of the main nozzle or in the direction of the flow of the arc-extinguishing gas through the main nozzle throat. The main nozzle throat may form a substantially or strictly converging flow duct for the flow of the arc-extinguishing gas in the second half of the length of the main nozzle throat.

The cross-sectional area of the main nozzle throat may be regarded as a function A(x) of the position x on the axis. Similarly, for the cases with discrete or continuous rotational symmetry, where the cross-sectional area is related to a circumradius or radius, the circumradius or radius R(x) can be viewed as a function of the position x on the axis. A(x) is then proportional to the square of R(x). Without loss of generality, x=0 at the first end of the main nozzle throat towards the auxiliary nozzle throat, and x=L at the second end of the main nozzle throat away from the auxiliary nozzle throat or towards the diffuser portion, where L is the length of the main nozzle throat. The positive x-axis is therefore oriented to point in the direction away from the auxiliary nozzle throat and towards the diffuser portion of the main nozzle, i.e. in the direction of the flow of the arc-extinguishing gas through the main nozzle throat. Mathematical properties of these functions or their derivatives translate into geometrical properties of the shape of the main nozzle throat.

In the following, such mathematical properties are specified, any of which alone or in combination may apply to the shape of the main nozzle throat. The properties are given for the function A(x), but similar relations may apply to the corresponding function R(x).

For A(x) the inequality A(0)>A(L) holds. The function value A(0) may be the largest value of the function, so A(0)=Amax. The function value A(L) may be the smallest value of the function, so A(L)=Amin. A(x) may be a bounded function with an upper bound $C_{up}$ and a lower bound $C_{low}$. The constant $C_{up}$ may lie in the range from A(0) to A(0)+y, and the constant $C_{low}$ may lie in the range from A(L)−y to A(L), and y may be, e.g., A(0)/d or A(L)/d or L/d with d larger than or equal to 10, larger than or equal to 50, or even larger than or equal to 100. The lower bound $C_{low}$ needs to be larger than the maximal radial extension of the end of the first arcing contact unit, because that end needs to be able to pass through the main nozzle throat. Any of these properties may hold for the function R(x), as well.

Figure 3:
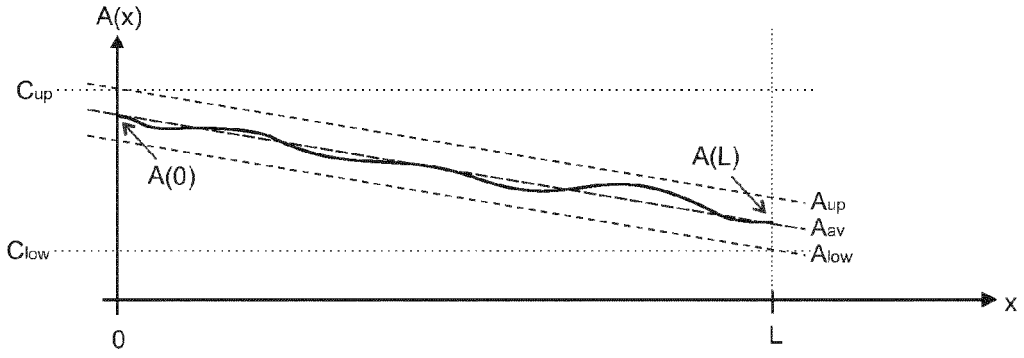
FIGS. 3-5 illustrate properties, which a main nozzle throat of a main nozzle of gas-insulated high-voltage switching devices according to embodiments may possess.

The mean derivative of the function A(x) is $A_{bar}'=1/L \int_L A'(x)\,dx=(A(L)-A(\mathbf{0}))/L$. The function $A_{av}(x)$ shall be the straight line with slope $A_{bar}'$ anchored at A(0) or A(L), i.e. $A_{av}(x)=A(\mathbf{0})+A_{bar}'*x$, where $A_{bar}'$ is negative and $A_{av}(L)=A(L)$. A(x) may be upper bounded by the straight line $A_{up}(x)=A(\mathbf{0})+y+A_{bar}'*x$ and lower bounded by the straight line $A_{low}(x)=A(\mathbf{0})-y+A_{bar}'*x$, where y may be as above. The function A(x) can be viewed as the sum of $A_{av}(x)$ and an undulation function u(x) which is bounded by ±y and for which u(0)=u(L)=0. The function A(x) may alternatively be viewed as the sum of a strictly monotonously decreasing function $A_{mon}(x)$ and an undulation function v(x) which is bounded by ±y and for which v(0)=v(L)=0. So, A(x) is globally decreasing along the length L of the main nozzle throat, but possibly not locally due to a non-zero v(x) or u(x). Still, some or all of such A(x) may be said to be substantially decreasing. Some of these properties are illustrated in FIG. 3. Any of these properties may hold for the function R(x).

The cross-sectional area function A(x) may be substantially decreasing or strictly monotonously decreasing on sub-intervals of the interval [0, L]. The mean derivative of A(x) taken over some or all sub-intervals may be negative. In particular, A(x) may be substantially decreasing or strictly monotonously decreasing in the interval [L/2, L], and the mean derivative taken over that sub-interval may be negative. Let $p=(p_i)$, i=0 . . . m, be a partition of the interval [0, L], where m is an integer (e.g. 2, 3, 4, 5, 6, 7, 8 or more) and $p_0=0$ and $p_m=L$. The partition may define sub-intervals of equal length. Then, A(x) may be substantially decreasing or strictly monotonously decreasing in 50%, 60%, 70%, 80%, 90%, 95% or even 100% of all the sub-intervals defined by the partition p. These properties may hold for the sub-intervals defined by the partition numbers $p_i$ with larger indices, e.g. for the ordered sub-set of indices {m1, . . . , m} with m1 larger or equal to, e.g., 1, 2, 3, 4, 5, 6. The mean derivative of A(x) taken over sub-intervals defined by the partition p may be negative for 50%, 60%, 70%, 80%, 90%, 95% or even 100% of all the sub-intervals defined by the partition p. This property may hold for the sub-intervals defined by the partition numbers $p_i$ with larger indices, e.g. for the ordered sub-set of indices {m1, . . . m} with m1 larger or equal to 1, 2, 3, 4, 5, 6. Any one of or all of these properties may hold for a refinement of the partition p, as well. Any of these properties may hold for the function R(x), as well.

Figure 4:
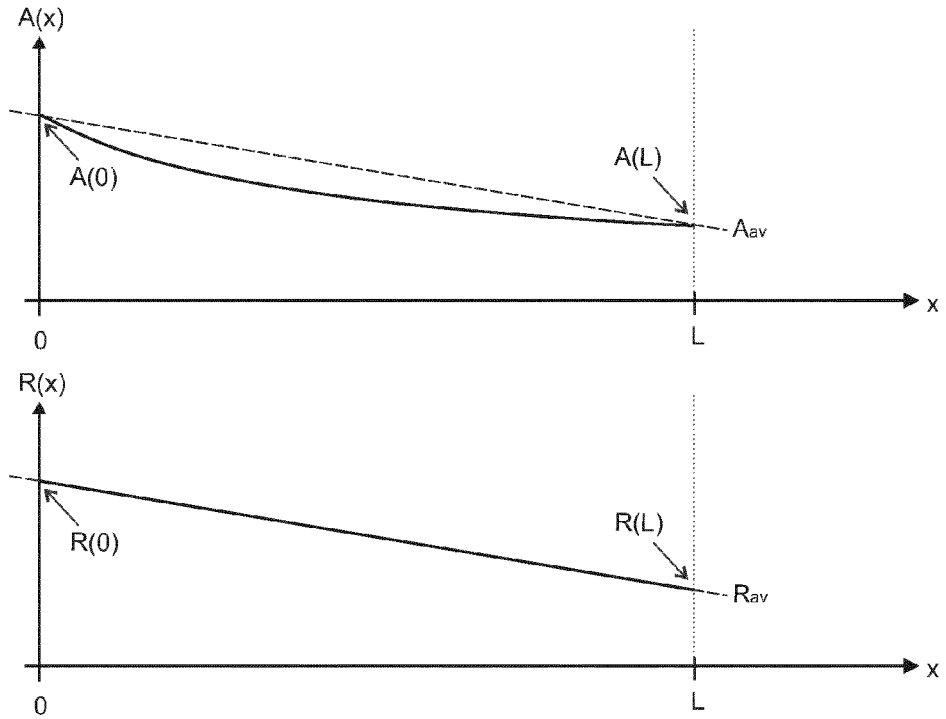
Figure 5:
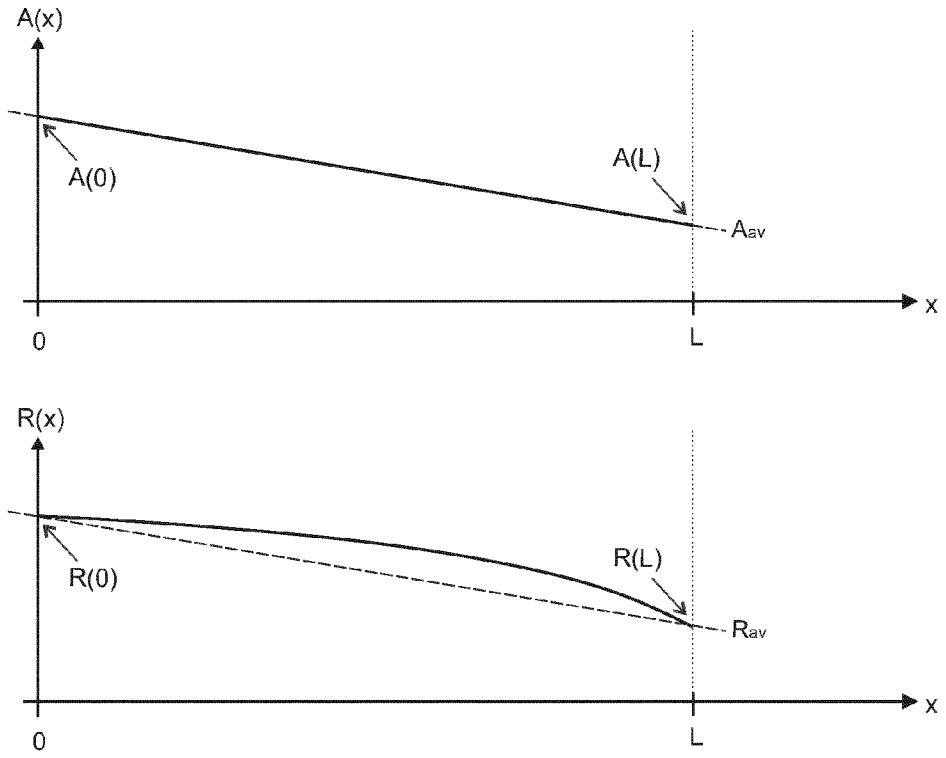

In typical embodiments, A(x) is strictly monotonously decreasing, so $A(x_1)>A(x_2)$ if $x_1<x_2$. As schematically shown in FIG. 4, A(x) may be quadratically decreasing, i.e. A(x) has the form of a parabola. A corresponding circumradius or radius R(x) is a straight line $R(x)=R_{av}(x)=R(\mathbf{0})+x*1/L \int_L R'(x)\,dx=R(\mathbf{0})+R_{bar}'*x$, where the mean derivative $R_{bar}'=1/L \int_L R'(x)\,dx=(R(L)-R(\mathbf{0}))/L$ is related to the aperture angle α by $-\tan \alpha=R_{bar}'$, the minus sign appearing, because α was defined to be positive. As schematically shown in FIG. 5, A(x) may be linearly decreasing, i.e. $A(x)=A_{av}(x)$ wherein $A_{av}(x)$ is as defined above. The corresponding circumradius or radius R(x) would then be strictly monotonously decreasing like a square root function.

At least one of the following may hold for all x in the range 0 to L: the derivative A'(x) may be smaller than or equal to zero, the derivative A'(x) may be smaller than zero, the derivative A'(x) may be smaller than a negative constant C1, the derivative A'(x) may be bounded, the derivative A'(x) may be larger than a negative constant C2 with C1>C2, the derivative A'(x) may be linearly decreasing or be a negative constant, the derivative R'(x) may be smaller than or equal to zero, the derivative R'(x) may be smaller than zero, the derivative R'(x) may be smaller than a negative constant C3, the derivative R'(x) may be bounded, the derivative R'(x) may be larger than a negative constant C4 with C3>C4, the derivative R'(x) may be a negative constant. Further, at least one of the following may hold for all x in the range 0 to L with respect to the second derivatives A"(x) or R"(x), respectively: it may be smaller than or equal to zero, it may be smaller than zero, it may be larger than or equal to zero, it may be larger than zero, it may be bounded, it may be about zero.

When an arc forms during circuit breaking of the circuit breaker or during switching of the switching device, the arc may ablate material, in particular within the main nozzle, and specifically within the main nozzle throat. The shape of the main nozzle throat may thereby change in an unpredictable and uncontrolled way. The formation and attempt of extinguishing of an arc are called a switching operation. In low short-circuit current duty, the switching current is typically larger than the nominal current, but less than 0.3 times the rated short-circuit current, e.g. at most 24 kA. The surface of the main nozzle throat becomes rough after some short-circuit switching operations, its roughness Rz being greater than e.g. 40 μm or even greater than 80 μm.

A skilled person can see, if a circuit breaker or switching device has been used, i.e. if one or more switching operations have taken place, which becomes visible e.g. by the increased roughness. According to embodiments, the main nozzle is as-fabricated or as-manufactured, i.e. in the state after a controlled manufacturing process and before having been used, i.e. before it has experienced a switching operation. The interior surface of the main nozzle, or at least the surface within the main nozzle throat, may have a surface roughness Rz smaller than 30 μm or even smaller than 20 μm, e.g. in the range from 1 μm to 15 μm. Due to the main nozzle throat having the desired shape ab initio, at least the first switching operation, but most likely also the following switching operations will benefit from the higher gas density of the arc-extinguishing gas in the arcing zone in front of the end of the first arcing contact unit (e.g. arcing contact pin), in particular for the low short-circuit current duties.

According to further embodiments, a method of manufacturing a gas-insulated high-voltage switching device is provided. The gas-insulated high-voltage switching device may be a circuit breaker or other switching device according to any of the embodiments described herein. The method includes controlled shaping of the main nozzle throat of the main nozzle of the gas-insulated high-voltage switching device to form the substantially converging duct for the flow of the arc-extinguishing gas. Controlled shaping of the main nozzle throat may include sintering the main nozzle, in particular sintering the main nozzle in close-to-final state, and machining the main nozzle throat.

According to yet further embodiments, a method of operating a gas-insulated high-voltage switching device is provided. The gas-insulated high-voltage switching device may be a circuit breaker or other switching device according to any of the embodiments described herein. The method includes providing the gas-insulated high-voltage switching device, and performing a low short-circuit current switching operation, e.g. current breaking for a low short-circuit current duty. Therein, the switching current of the low short-circuit current switching operation or current breaking may be smaller than 0.3 times the rated short-circuit current. The rated short-circuit current may be between 31.5 kA and 80 kA. The low short-circuit current operation may be one of T10, T30 or out-of-phase duty. The switching current of low short-circuit current operation may be about 10% of the rated short-circuit current, as in T10 duty, or may be about 25% of the rated short-circuit duty, as in out-of-phase duty, or may be about 30% of the rated short-circuit duty, as in T30 duty. For instance, if the rated short-circuit current is 40 kA and the nominal current is 4 kA, then T10 duty has a switching current of 4 kA, which is about the nominal current, while T30 duty has a switching current of 12 kA, which is about three times the nominal current. If the rated short-circuit is 63 kA, T30 duty needs to deal with a switching current of 18.9 kA, which is more than three times the nominal current. The switching operation or current breaking may be the first switching operation, at least for the main nozzle.

A further aspect of the invention and according embodiments are directed to a main nozzle for a gas-insulated high-voltage switching device. The main nozzle may have any or all of the properties of main nozzles of gas-insulated high-voltage switching devices described herein.

The arc-extinguishing gas may be an insulating gas with arc-extinguishing properties, like SF6, N2, CO2, air or mixtures of such gases with each other. Typical filling pressures arc a few bar, typically between 4 and 12 bar, such as about 10 bar for CO2 and about 6 to 7 bar for SF6. Further filling gases may comprise an organofluorine compound being selected from the group consisting of: a fluoroether, an oxirane, a fluoroamine, a fluoroketone, a fluoroolefin, fluronitrile, and mixtures and/or decomposition products thereof. Herein, the terms "fluoroether", "oxirane", "fluoroamine", "fluoroketone", "fluoroolefin" and "fluoronitrile" refer to at least partially fluorinated compounds. In particular, the term "fluoroether" encompasses both fluoropolyethers (e.g. galden) and fluoromonoethers as well as both hydrofluoroethers and perfluoroethers, the term "oxirane" encompasses both hydrofluorooxiranes and perfluorooxiranes, the term "fluoroamine" encompasses both hydrofluoroamines and perfluoroamines, the term "fluoroketone" encompasses both hydrofluoroketones and perfluoroketones, the term "fluoroolefin" encompasses both hydrofluoroolefins and perfluoroolefins, and the term "fluronitrile" encompasses both hydrofluornitriles and perfluoronitriles. It can thereby be preferred that the fluoroether, the oxirane, the fluoroamine, the fluoroketone and the fluoronitriles are fully fluorinated, i.e. perfluorinated.

The invention claimed is:

1. A gas-insulated high-voltage switching device, comprising:

an arcing contact arrangement comprising a first arcing zone member and a second arcing zone member, wherein the first arcing zone member and the second arcing zone member are movable relative to one another along an axis (B), wherein the first arcing zone member comprises a first arcing contact unit; and wherein the second arcing zone member comprises:

a second arcing contact unit configured to receive the first arcing contact unit;

an auxiliary nozzle surrounding at least a part of the second arcing contact unit and having an auxiliary nozzle throat which has an axial extension and allows passage at least of an end of the first arcing contact unit, a main nozzle surrounding at least a part of the auxiliary nozzle, and having a main nozzle throat, which has an axial extension sideways of the auxiliary nozzle throat and allows passage at least of the end of the first arcing contact unit, a cross-sectional area of the main nozzle throat is decreasing in an axial direction away from the auxiliary nozzle throat so as to form a converging flow duct for a flow of an arc-extinguishing gas wherein the converging flow duct of the main nozzle throat has a length L in the axial direction in a range of 15 mm to 80 mm, and the main nozzle throat has an aperture angle α in a range from more than 0° to at most 15° and a shape of the main nozzle throat is frusto-conical.

2. The gas-insulated high-voltage switching device according to claim 1, wherein a larger cross-sectional area of the main nozzle throat is at a first end of the main nozzle throat adjacent to a heating channel and a narrower cross-sectional area of the main nozzle throat is at a second end of the main nozzle throat remote from the heating channel.

3. The gas-insulated high-voltage switching device according to claim 1, wherein the converging flow duct of the main nozzle is converging in downstream direction of the arc-extinguishing gas.

4. The gas-insulated high-voltage switching device according to claim 3, wherein an axial position of a stagnation point of the arc-extinguishing gas is located upstream of the converging flow duct of the main nozzle.

5. The gas-insulated high-voltage switching device according to claim 1, wherein the main nozzle throat has a largest cross-sectional area Amax at a first end of the main nozzle throat towards the auxiliary nozzle throat, and has a smallest cross-sectional area Amin at a second end of the main nozzle throat away from the auxiliary nozzle throat.

6. The gas-insulated high-voltage switching device according to claim 1, wherein the main nozzle throat has an n-fold discrete rotational symmetry or a continuous rotational symmetry with respect to the axis (B).

7. The gas-insulated high-voltage switching device according to claim 1, wherein the main nozzle throat is continuously rotational symmetric with respect to the axis (B), has a largest cross-sectional area $Amax=\pi Rmax^2$ with Rmax=maximal radius of the main nozzle throat, at a first end of the main nozzle throat towards the auxiliary nozzle throat, and has a smallest cross-sectional area $Amin=\pi Rmin^2$ with Rmin=minimal radius of the main nozzle throat at a second end of the main nozzle throat away from the auxiliary nozzle throat, wherein Rmax and Rmin are radii measured from the axis (B).

8. The gas-insulated high-voltage switching device according to claim 1, wherein $\alpha=\arctan((Rmax-Rmin)/L)$ with Rmin=minimal radius and Rmax=maximal radius of the main nozzle throat with a radii being measured from the axis (B), and L is the length of the main nozzle throat along the axis (B), with Rmax, Rmin or a mean radius of the main nozzle throat or of the converging flow duct lying in a range from 5 mm to 20 mm.

9. The gas-insulated high-voltage switching device according to claim 1, wherein the main nozzle throat is strictly monotonously converging.

10. The gas-insulated high-voltage switching device according to claim 9, wherein the cross-sectional area of the main nozzle throat decreases quadratically along the length of the main nozzle throat.

11. The gas-insulated high-voltage switching device according to claim 1, wherein the main nozzle comprises a diffuser portion adjacent to and downstream of the main nozzle throat, the diffuser portion being divergent in a direction away from the auxiliary nozzle throat, thereby forming a diverging duct for the flow of an arc-extinguishing gas.

12. The gas-insulated high-voltage switching device according to claim 1, comprising a pressure volume, wherein the second arcing zone member comprises a heating channel formed between the main nozzle and the auxiliary nozzle, the heating channel being in fluid communication on one end with the pressure volume and on the other end with a part of an arcing zone (Z) lying between the auxiliary nozzle throat and the main nozzle throat.

13. The gas-insulated high-voltage switching device according to claim 1, wherein the first arcing contact unit is an arcing contact pin, and the second arcing contact unit is an arcing contact tulip.

14. The gas-insulated high-voltage switching device according to claim 1, wherein an interior surface of the main nozzle has a surface roughness Rz smaller than 20 μm at least in the main nozzle throat.

15. The gas-insulated high-voltage switching device according to claim 1, wherein the gas-insulated high-voltage switching device is a gas-insulated high-voltage self-blast circuit breaker.

16. The gas-insulated high-voltage switching device according to claim 1, wherein a convergent profile of the insulating nozzle throat helps to have a higher flow velocity at a second end of the nozzle throat away from the auxiliary nozzle throat, which higher flow velocity supports a more effective removal of a hot gas that resides in a region adjacent to an end of a contact pin after an arc has been extinguished thermally.

17. A method of manufacturing the gas-insulated high-voltage switching device according to claim 1, the method comprising:

controlled shaping of the main nozzle throat to forming the converging flow duct for the flow of the arc-extinguishing gas.

18. The method according to claim 17, wherein controlled shaping of the main nozzle throat comprises sintering and machining the main nozzle.

19. The gas-insulated high-voltage switching device according to claim 1, wherein a larger cross-sectional area of the main nozzle throat is at a first end of the main nozzle throat adjacent to a heating channel and a narrower cross-sectional area of the main nozzle throat is at a second end of the main nozzle throat remote from a heating channel.

20. The gas-insulated high-voltage switching device according to claim 1, wherein the main nozzle throat has a largest cross-sectional area Amax at a first end of the main nozzle throat towards the auxiliary nozzle throat, and has a smallest cross-sectional area Amin, $Amin=\pi Rmin^2$ with Rmin=minimal radius of the main nozzle throat, at a second end of the main nozzle throat away from the auxiliary nozzle throat.

21. The gas-insulated high-voltage switching device according to claim 1, wherein the gas-insulated high-voltage switching, device is a gas-insulated high-voltage self-blast circuit breaker.

22. The gas-insulated high-voltage switching device according to claim 21, wherein the gas-insulated high-voltage switching device is a double motion self blast circuit breaker.

23. A method of operating a gas-insulated high-voltage switching device, the method comprising:

providing a gas-insulated high-voltage switching device, comprising:

an arcing contact arrangement comprising a first arcing zone member and a second arcing, zone member, wherein the first arcing zone member and the second arcing zone member are movable relative to one another along an axis (B), wherein the first arcing zone member comprises a first arcing contact unit; and wherein the second arcing zone member comprises:

a second arcing contact unit configured to receive the first arcing contact unit;

an auxiliary nozzle surrounding at least a part of the second arcing contact unit and having an auxiliary nozzle throat which has an axial extension and allows a passage at least of an end of the first arcing contact unit;

a main nozzle surrounding at least a part of the auxiliary nozzle, and having a main nozzle throat, which has an axial extension sideways of the auxiliary nozzle throat and allows passage at least of the end of the first arcing contact unit, a cross-sectional area of the main nozzle throat is decreasing in an axial direction away from the auxiliary nozzle throat so as to form a converging flow duct for a flow of an arc-extinguishing gas, wherein the converging flow duct of the main nozzle throat has a length L in the axial direction in a range of 15 mm to 80 mm, and the main nozzle throat has an aperture angle $\alpha$ in a range from more than 0° to at most 15° and a shape of the main nozzle throat is frusto-conical;

performing a low short-circuit current switching operation, wherein a switching current is smaller than 0.3 times a rated short-circuit current.

24. The gas-insulated high-voltage switching device according to claim 23, wherein the rated short-circuit current is between 31.5 kA and 80 kA.

* * * * *